US006018936A

United States Patent [19]

Kuei

[11] Patent Number: 6,018,936

[45] Date of Patent: Feb. 1, 2000

[54] TAPE-LEADING MECHANISM FOR AN AUTOMATIC PACKER

[75] Inventor: Li Pi Kuei, Taiepi Hsien, Taiwan

[73] Assignee: Gin Dah Enterprises Corp., Taipei Hsien, Taiwan

[21] Appl. No.: 09/205,836

[22] Filed: Dec. 3, 1998

[51] Int. Cl.[7] ..... B65B 13/22

[52] U.S. Cl. ..... 53/589; 53/389.2; 100/32

[58] Field of Search ..... 53/389.4, 389.2, 53/589, 582; 100/32, 26, 25, 8, 29

[56] References Cited

U.S. PATENT DOCUMENTS 4,724,659 2/1988 Mori et al. ..... 53/589

4,885,901 12/1989 Sakaki et al. ..... 53/589

*Primary Examiner*—Linda Johnson

*Attorney, Agent, or Firm*—W. Wayne Liauh

[57] ABSTRACT

Disclosed is a tape tightening mechanism for an automatic packer including a conventionally structured tension arm and a rail having an upper end pivotally connected to a top rear end of the tension arm and a lower end leading to an upper end of a tape-feeding channel, so that a tape for packing can be fed from the tape-feeding channel to a tape-operating unit of the packer via the rail and the tension arm. A vertical section extends downward from the lower end of the rail and forms a stop wall to a top rear side of the tape-feeding channel. When the tension arm is swung backward to tighten the tape around a package, the rail connected thereto is pushed to move backward, causing the vertical section to separate from the top rear end of the tape-feeding channel to provide a widened path between them for the tape to pass therethrough and enter the rail without becoming bent. When the tension arm is in a tape tightening position, a part of the tape is pushed back into a tape storage, and when the tension arm returns to its original position, the tape can be pulled out from the storage again for packing.

2 Claims, 4 Drawing Sheets

TAPE-LEADING MECHANISM FOR AN AUTOMATIC PACKER

BACKGROUND OF THE INVENTION

The present invention relates to a tape tightening mechanism for an automatic packer which can be easily manufactured for accurate and convenient operation by users.

When using an automatic packer, a tape for binding the package must be sent into a tape rail located at an upper part of the packer. The tape in the tape rail is then pulled backward in order to tighten around the package. This is the first backward pulling of the tape. Another backward pulling of the tape with stronger force is needed to further tighten the package before the tape can be molten and cut to complete the packing. The automatic packer includes a tape-operating unit for feeding and backward pulling the tape.

Most of the automatic packers available in the markets have a tape-operating unit capable of feeding tape and performing first and second backward pulling of tape to pack a package. Such tape-operating unit performs the first backward pulling of tape by a rotatable rear wheel which rotates at slow speed and has small driving force and therefore the packing operation is inefficient and the tape can not be well tightened around the package. For packages that need to be highly tightened, such type of automatic packer is not suitable at all.

Moreover, the automatic packer is provided with a tension arm to perform the second backward pulling of tape to further tighten the tape around the package. As shown in FIG. 1, the tension arm 10 is swung backward by a rotating cam 11 to pull the tape backward. The tension arm 10 has a front end contacting with a rear end of the tape-operating unit 12 and a rear end connected to a curved rail 13 which houses a fixed curved rail 14 having the same radius of curvature as that of the curved rail 13. When the tension arm 10 swings forth and back about a shaft thereof, the curved rail 13 connected to its rear end moves at the same time but remains in a state of housing the fixed curved rail 14. That is, when the tension arm 10 swings backward to perform the second backward pulling of tape, the backward pulled tape would be partially sent back into a tape storage (not shown) via the partially telescoped curved rails 13 and 14. Such mechanism for the tension arm 10 to perform the second backward pulling of tape enables better tightening of the package. However, it is very important the two curved rails 13 and 14 are manufactured with highly accurate curvature to enable successful second backward pulling of tape. Therefore, such tape tightening mechanism is difficult to manufacture and requires higher manufacturing cost. Furthermore, there are many limitations in the installation of such tape tightening mechanism to ensure good housing of the curved rail 13 around the curved rail 14 when the tension arm 10 swings.

It is therefore tried by the inventor to develop an improved tape tightening mechanism for an automatic packer to eliminate the drawbacks found in the conventional tape-tightening mechanism for second backward pulling of tape.

SUMMARY OF THE INVENTION

A primary object of the present invention is to provide a tape tightening mechanism for an automatic packer that has simple structure and can be easily manufactured and installed to reduce manufacturing cost thereof.

To achieve the above and other objects, the present invention includes a tension arm and a rail pivotally connected at an upper end to a top rear end of the tension arm. The other lower end of the rail leads to an upper end of a tape-feeding channel, so that a tape for packing is fed to the tape-operating unit via the tape-feeding channel, the rail, and the tension arm. A vertical section downward extends from the lower end of the rail and forms a stop wall to a top rear side of the tape-feeding channel. When the tension arm swings backward to perform a backward pulling of tape to tighten the latter around a package, the rail is pushed by the tension arm to move backward at the same time, causing the vertical section at the lower end of the rail to separate from the tape-feeding channel and provides a widened path for the tape to pass therethrough and enter into the rail without becoming bent.

A roller is provided on an upper end of the vertical section to rotate on an inclination-adjustable planar surface, so as to decide an inclination for the rail when it is pushed by the tension arm to move backward. Moreover, a spring included in the mechanism is connected at an upper end to the rail and thereby pulls the rail downward, so that the roller on the upper end of the vertical section always fitly contacts with the planar surface when the rail moves.

BRIEF DESCRIPTION OF THE DRAWINGS

The above and other objects and the features of the present invention can be best understood by referring to the following detailed description of the preferred embodiments and the accompanying drawings, wherein.

DETAILED DESCRIPTION OF THE PREFERRED EMBODIMENTS

Figure 1:
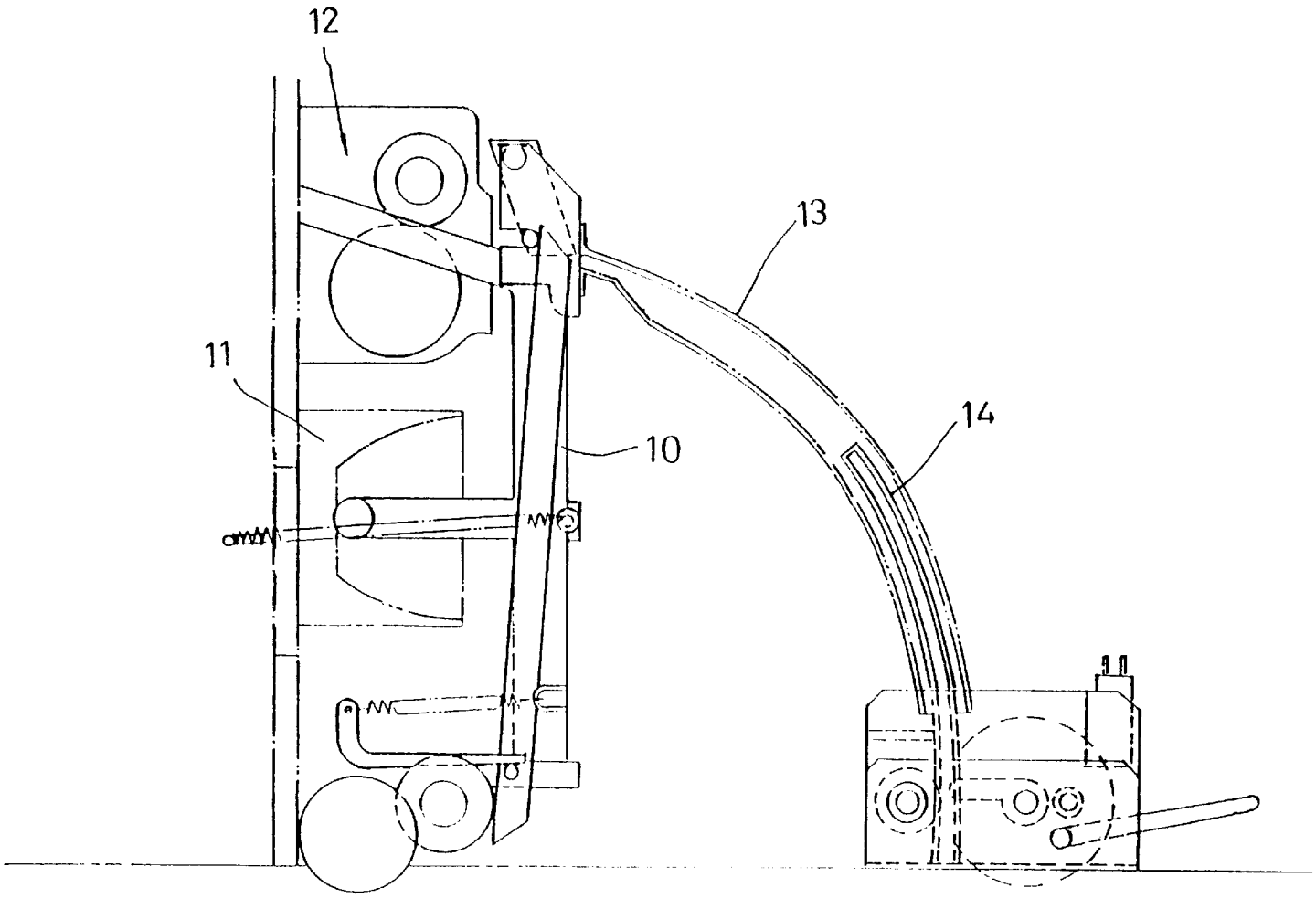
FIG·1 (Prior Art)
FIG. 1 is a side view showing the structure of a conventional tape tightening mechanism for an automatic packer.
Figure 2:
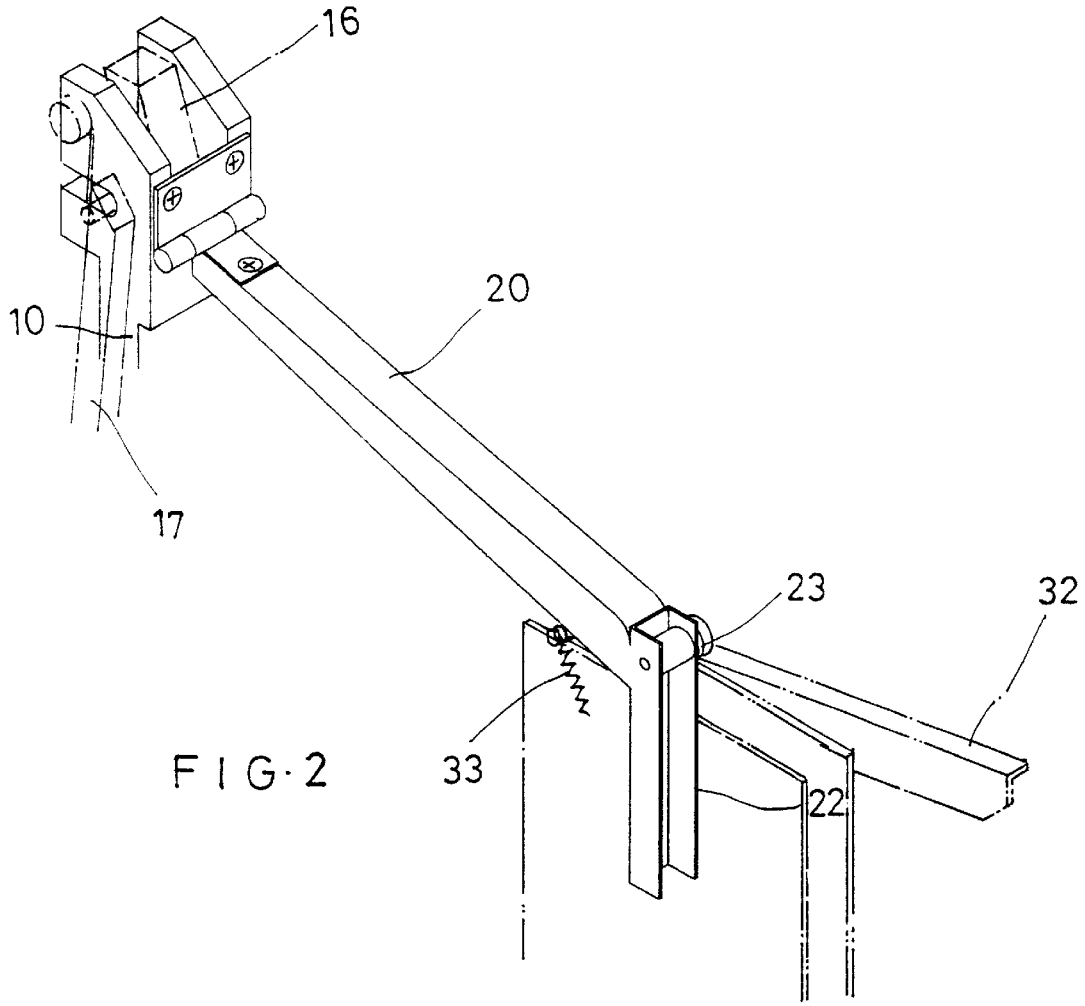
FIG. 2 is a perspective view of a tape tightening mechanism for an automatic packer according to the present invention.
Figure 3:
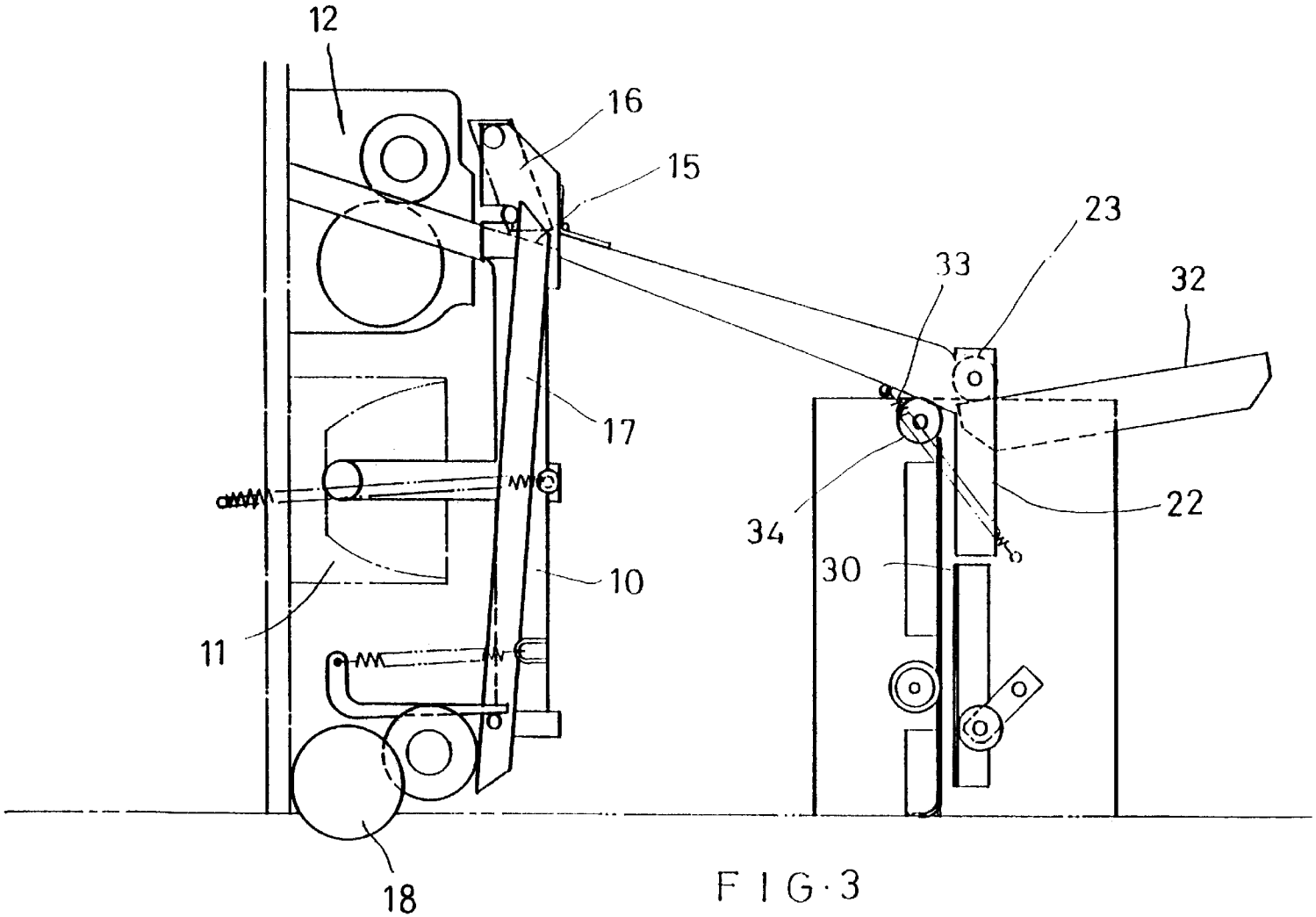
FIG. 3 is a side view showing the structure of the tape tightening mechanism of FIG. 2.

Please refer to FIGS. 2 and 3. The present invention refers to an improved tape tightening mechanism for an automatic packer. The mechanism includes a tension arm 10 that is basically structurally similar to the tension arm 10 used in the conventional tape tightening mechanism for an automatic packer. A rail 20 is connected at a first or upper end to a top rear end of the tension arm 10 such that the rail 20 is pivotally turnable up and down relative to the tension arm 10 when the tension arm 10 swings forth and back. A second or lower end of the rail 20 leads to an upper end of a tape-feeding channel 30 included in the tape tightening mechanism, such that a bottom opening 21 provided near the second end of the rail 20 faces and aligns with an upper end opening 31 of the tape-feeding channel 30 when the tension arm 10 is in a normal or original position. A vertical section 22 downward extends a predetermined length from the second end of the rail 20 and forms a stop wall to a top rear side (that is, the side facing away from the tension arm 10) of the tape-feeding channel 30. The vertical section 22 is provided at a top outer side with a roller 23 which may rotate on and along a planar surface 32 while the planar surface 32 is adjustable to have different inclination. Therefore, the roller 23 and the planar surface 32 together decide the inclination of the rail 20 when the rail 20 moves. The lower end of the rail 20 is pulled downward by a spring 33 mounted below it, so that the roller 23 connected to the vertical section 22 of the rail 20 always fitly contacts with the planar surface 32 while it rotates on and along the planar surface 32.

The tension arm 10 has a tape passage 15 therein. A first or front end of the tape passage 15 leads to a tape inlet provided on a tape-operating unit 12 of the automatic packer, A second or rear end of the tape passage 15 is connected to the first or upper end of the rail 20. With these arrangements, a tape 40 is fed from a tape storage (not shown) of the automatic packer to the tape-operating unit 12 via the tape-feeding channel 30, the rail 20, and the tape passage 15 of the tension arm 10. The tape-operating unit 12 then operates to send the tape 40 into a tape rail (not shown), preparing the automatic packer for packing. The tape-operating unit 12 is designed mainly to send tape and to perform a first backward pulling of tape 40.

Figure 4:
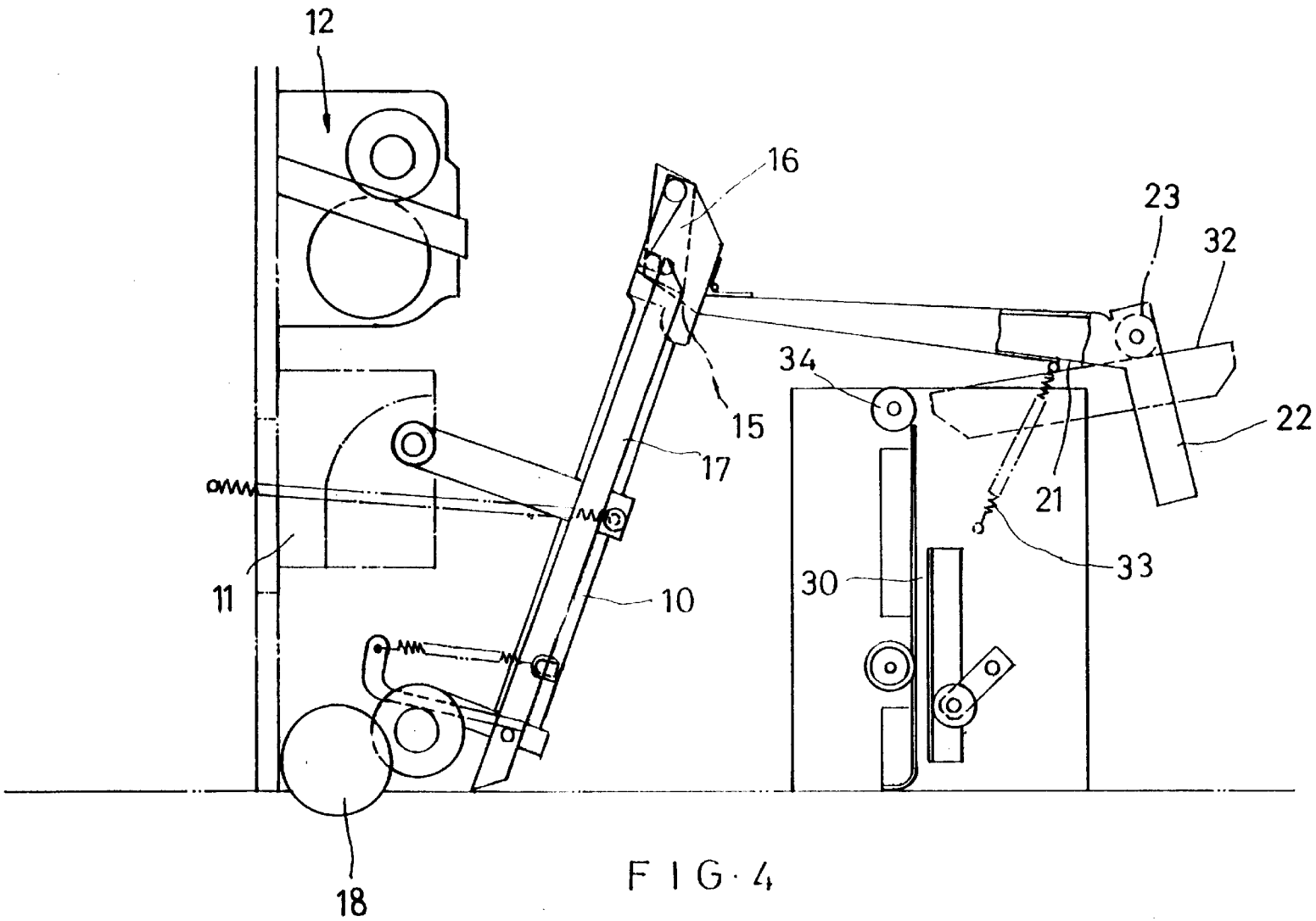
FIG. 4 is a side view showing the operation of the tension arm and the tape tightening mechanism of the present invention to backward pull and tighten a tape.

Please refer to FIG. 4. When the cam 11 rotates to cause the tension arm 10 to swing backward and thereby tightens the tape 40, the rail 20 is pushed by the tension arm 10 to move backward at the same time. The roller 23 connected to the upper end of the vertical section 22 rotates along the planar surface 32 and limits changes in height of the lower end of the rail 20 to a range decided by the inclination of the planar surface 32. Meanwhile, the vertical section 22 downward extended from the lower end of the rail 20 is moved away from the top rear end of the tape-feeding channel 30 to provide a length of widened tape-feeding channel 30 between the vertical section 22 and the top end of the tape-feeding channel 30. This widened tape-feeding channel 30 on the one hand keeps the tape 40 moving within a normal feeding path and on the other hand prevents the tape 40 from being bent when the tape 40 passes the widened tape-feeding channel 30. When the tension arm 10 returns to its original position, the vertical section 22 of the rail 20 pushes a part of the tape 40 back into the tape storage. And, when the tension arm 10 is about to contact with the tape-operating unit 12 again, the vertical section 22 will also function to push the tape 40 toward the tape-operating unit 12 to complete the packing.

The tension arm 10 is a member of prior art having a clamping jaw 16 provided therein. The clamping jaw 16 is pushed by an adjusting rod 17 to clamp the tape 40 in the tape passage 15, so that the tape 40 is pulled backward and tightened by the tension arm 10 when the latter is caused to swing backward. This causes the tape 40 to be pulled backward and tightened for a second time. The push of the clamping jaw 16 by the adjusting rod 17 to clamp the tape 40 generates when the tension arm 10 is swung backward to a certain position. When the tension arm 10 keeps swinging backward, it also defines a length of the tape 40 to be pulled backward for tightening purpose. Another cam 18 is provided to cooperate with the adjusting rod 17 to adjust the timing of such backward pulling of tape 40 so as to achieve a desirable packing tightness.

The bottom opening 21 of the rail 20 can be extended forward to some extent, so long as the tape 40 can be successfully fed from the tape-feeding channel 30 into the rail 20 without being interrupted by a roller 34 mounted on a top front stop wall of the tape-feeding channel 30.

When the tension arm 10 is in its normal state, that is, in its original position, the tape 40 enters the rail 20 from a rear side of the bottom opening 21. When the tension arm 10 swings backward and the rail 20 is pushed backward at the same time, the tape 40 automatically moves to a front side of the bottom opening 21. Since the bottom opening 21 of the rail 20 defines only a small difference of distance for the tape 40 entering the rail 20, the tape 40 would not become bent when it passes the widened tape-feeding channel 30.

The planar surface 32 for guiding the rail 20 can be adjusted to have different inclinations, so that the moving rail 20 can be adjusted for its lower end to have a maximal height that would not cause the tape 40 to bend.

With the above arrangements, the rail 20 of the tape tightening mechanism for an automatic packer according to the present invention can be easily manufactured at largely reduced cost. Moreover, it is easier to accurately install the rail 20. Therefore, the present invention is an ideal, practical, and novel design.

What is claimed is:

1. A tape tightening mechanism for an automatic packer, comprising a conventionally structured tension arm, a rail having an upper end pivotally connected to a top rear end of said tension arm and a lower end leading to a tape-feeding channel which has an upper end opening facing and aligning with a bottom opening of said rail, a vertical section downwardly extended from said lower end of said rail to normally locate and form a stop wall to a top rear side of said tape-feeding channel, a first roller provided to one outer side of an upper end of said vertical section, an inclination-adjustable planar surface on and along which said first roller rotates to decide an inclination for said rail when said rail is moved, and a spring mounted in said tape tightening mechanism with an upper end connected to said rail and thereby pulling said rail downward to keep said first roller always fitly contacting with said planar surface; whereby when said tension arm is caused to swing backward and thereby tightens a tape for packing, said rail is pushed by said backward swung tension arm to move backward while said first roller rotates along said inclined planar surface to limit height changes of said lower end of said rail during its backward movement, and said vertical section extended from the lower end of said rail separates from said tape-feeding channel to form a widened path for the tape to pass therethrough and enter said rail via said bottom opening of said rail without becoming bent.

2. A tape tightening mechanism for an automatic packer as claimed in claim 1, wherein said bottom opening of said rail can be extended forward for some extent, so long as the tape can be successfully fed from said tape-feeding channel into said rail without being interrupted by a second roller mounted on a top front stop wall of said tape-feeding channel.

* * * * *